US005092516A

United States Patent [19]

Kastanek

[11] Patent Number: 5,092,516

[45] Date of Patent: Mar. 3, 1992

[54] CARTON BLANK AND CARTON

[75] Inventor: Raymond S. Kastanek, Lafayette, Colo.

[73] Assignee: Graphic Packaging Corporation, Paoli, Pa.

[21] Appl. No.: 615,588

[22] Filed: Nov. 19, 1990

[51] Int. Cl.[5] ..... B65D 5/54

[52] U.S. Cl. ..... 229/226; 229/146; 229/160.1; 493/128; 493/183; 493/911

[58] Field of Search ..... 229/146, 160.1; 206/268, 273, 614, 615, 621, 624; 493/128, 156, 183, 911

[56] References Cited

U.S. PATENT DOCUMENTS

| | | | |
|---|---|---|---|
| 2,789,746 | 4/1957 | Houland | 229/146 |
| 3,085,736 | 4/1963 | Meyers | 206/615 |
| 3,207,416 | 9/1965 | Koltz et al. | 229/146 |
| 3,486,682 | 12/1969 | Mahon et al. | 229/160.1 |
| 3,524,581 | 8/1970 | Buttery | 206/615 |
| 3,758,023 | 9/1973 | Meyers | 206/615 |
| 3,979,047 | 9/1976 | Focke et al. | 229/160.1 |
| 4,114,777 | 9/1978 | Frohling et al. | 206/268 |
| 4,852,734 | 8/1989 | Allen et al. | 229/160.1 |
| 4,948,038 | 8/1990 | Moeller | 229/160.1 |

FOREIGN PATENT DOCUMENTS

| | | | |
|---|---|---|---|
| 2139192 | 11/1984 | United Kingdom | 229/160.1 |

OTHER PUBLICATIONS

Sheets CIG 10–17.

*Primary Examiner*—Gary E. Elkins
*Attorney, Agent, or Firm*—Klaas & Law

[57] ABSTRACT

A carton formed from a carton blank comprising a unitary sheet of material hvaing cut out portions, cut lines, fold lines and perforated lines to form various sections which are folded together to form a carton having a hinged lid which may be moved between closed and opened positions to remove materials from the carton and which lid is retained in the closed position by a frictional fit between portions of the lid and a front panel portion of the carton.

18 Claims, 6 Drawing Sheets

CARTON BLANK AND CARTON

FIELD OF THE INVENTION

This invention relates generally to carton blanks and cartons formed therefrom and more particularly to a carton formed from a single carton blank and wherein the carton has an integral movable lid.

BACKGROUND OF THE INVENTION

There are many cartons in general use which are formed from a single carton blank. In many instances, it is desirable to provide such cartons with a movable lid that can be moved between closed and opened positions so that materials may be removed from the carton. It is also necessary that these cartons be sealed after the desired materials have been dispensed therein so that there is no spillage during shipment and storage. Another desirable feature is that these cartons be provided with retaining means for holding the lid in a closed position, after removing a portion of the materials from the carton during actual use thereof, so that contaminating materials may not enter into the carton. This invention provides a carton formed from a single carton blank and having the foregoing desirable characteristics.

BRIEF DESCRIPTION OF THE INVENTION

This invention provides a carton formed from a unitary sheet of material having a left side edge, a right side edge, a top edge and a bottom edge, said left and right side edges being perpendicular to said top and bottom edges. A first plurality of spaced apart cut and fold lines extend from the top edge to the bottom edge, and a second plurality of spaced apart cut and fold lines extend from the top edge to the bottom edge to divide the unitary sheet of material into a center section, a left side section and a right side section. The center section has a plurality of transversely extending fold lines for dividing the center section from the top edge to the bottom edge into a lid front panel portion, a lid top panel portion, a lid back panel portion, a back panel portion, a bottom panel portion and a front panel portion. Each of the left and right side sections has cut out portions to divide each of the left and right side sections into first left and right side sub-sections, second left and right side sub-sections and third left and right side sub-sections. The first left and right side sub-sections comprise left and right lid outside side panel portions integral with the lid front panel portion. The second left and right side sub-sections comprise left and right lid top panel portions reinforcing tabs, left and right lid inside side panel portions, left and right inside side panel portions and left and right bottom panel portion reinforcing tabs. The third left and right sub-sections comprise left and right outside side panel portions. The carton blank is provided with fold lines, perforated lines and cut lines that are used to form a carton. In a series of folding and securing steps, portions of the carton blank are folded and secured together to form the material holding portion of the carton. After the desired materials have been deposited in the holding portion, a series of folding and securing steps form a lid for the carton and seal the carton for shipment, storage and sale.

A carton for holding material is formed from the carton blank and comprises front and back panel portions having the same height and width, opposite side panel portions and a bottom panel portion having a first width equal to the width of the front and rear panel portions and a second width equal to the width of the opposite side panel portions. The front and back panel portions, the opposite side panel portions and the bottom panel portion are connected together to form a carton having an open top portion. Each of the opposite side panel portions having a height at the juncture of the back panel portion and the opposite side panel portions that is greater than the height of the opposite side panel portions at the juncture of the front panel portion and the opposite side panel portions. A lid portion is hingedly secured to the back panel portion for permitting movement of the lid portion between closed and opened positions. The lid portion comprises a lid back panel portion hingedly secured to the back panel portion and having a height and a width. A lid front panel portion having a height greater than the height of the lid back panel portion and a width equal to the width of the lid back panel portion. Opposite lid side panel portions are provided and each has the same height and width. A lid top panel portion has a first width equal to the width of the lid front and back panel portions and a second width equal to the width of the opposite lid side panel portion. Each of the opposite lid side panel portions has a height at the juncture of the lid back panel portion and the opposite lid side panel portions that is less than the height of the opposite lid side panel portions at the juncture of the lid front panel portion and the opposite lid side panel portions. Portions of the front panel portion and the lid front panel portions are in superposed relationship when the lid portion is in the closed position and portions of the opposite side panel portions and portions of the opposite lid side panel portions are in superposed relationship when the lid portion is in said closed position. A portion of the lid front panel portion comprises a removable tab that is adhesively secured to a tear away panel portion on the front panel portion to provide for opening the carton so that the materials contained therein may be removed.

BRIEF DESCRIPTION OF THE DRAWINGS

An illustrative and presently preferred embodiment of the invention is shown in the accompanying drawings in which.

DETAILED DESCRIPTION OF THE INVENTION

Figure 14:
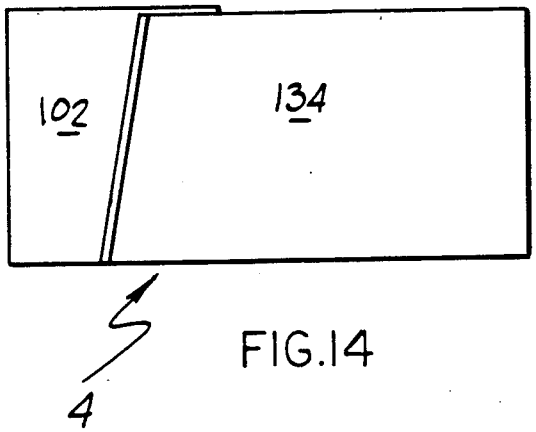
FIG. 14 is a side elevational view of FIG. 12.
Figure 15:
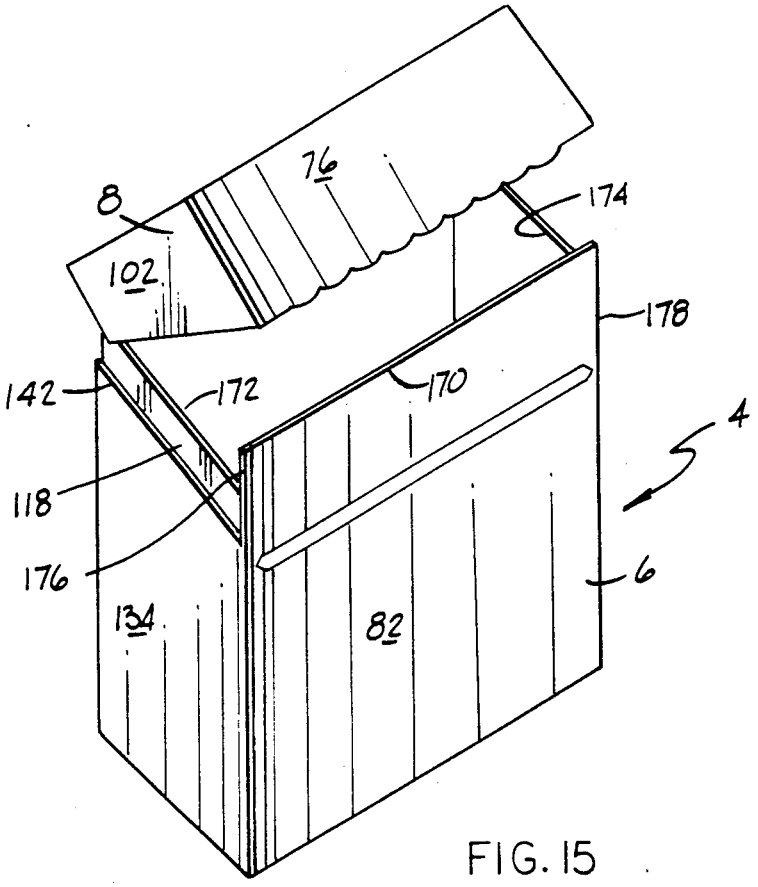
FIG. 15 is a perspective view of the carton in use and with the lid portion partially opened.
Figure 16:
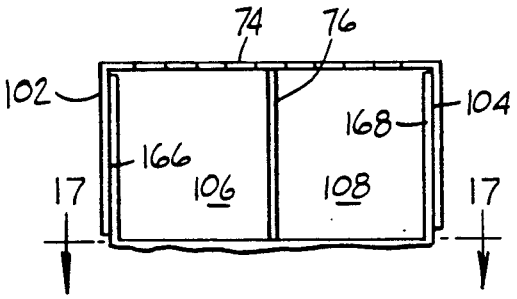
FIG. 16 is a partial front elevational view with the lid in an opened position with the top panel portion of the lid parallel to the front panel portion of the materials containing portion of the carton.
Figure 17:
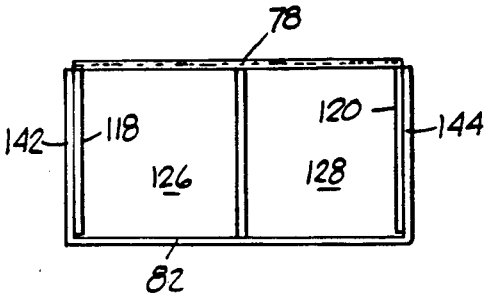
FIG. 17 is a cross-sectional view taken on the line 17—17 of FIG. 15.

A carton blank 2 is illustrated in FIGS. 1-17 which carton blank may be folded and sealed to form a carton 4 as illustrated in FIG. 15. The carton 4 has a bottom container portion 6 and a top lid portion 8 movable between closed and opened positions.

Figures 1, 2:
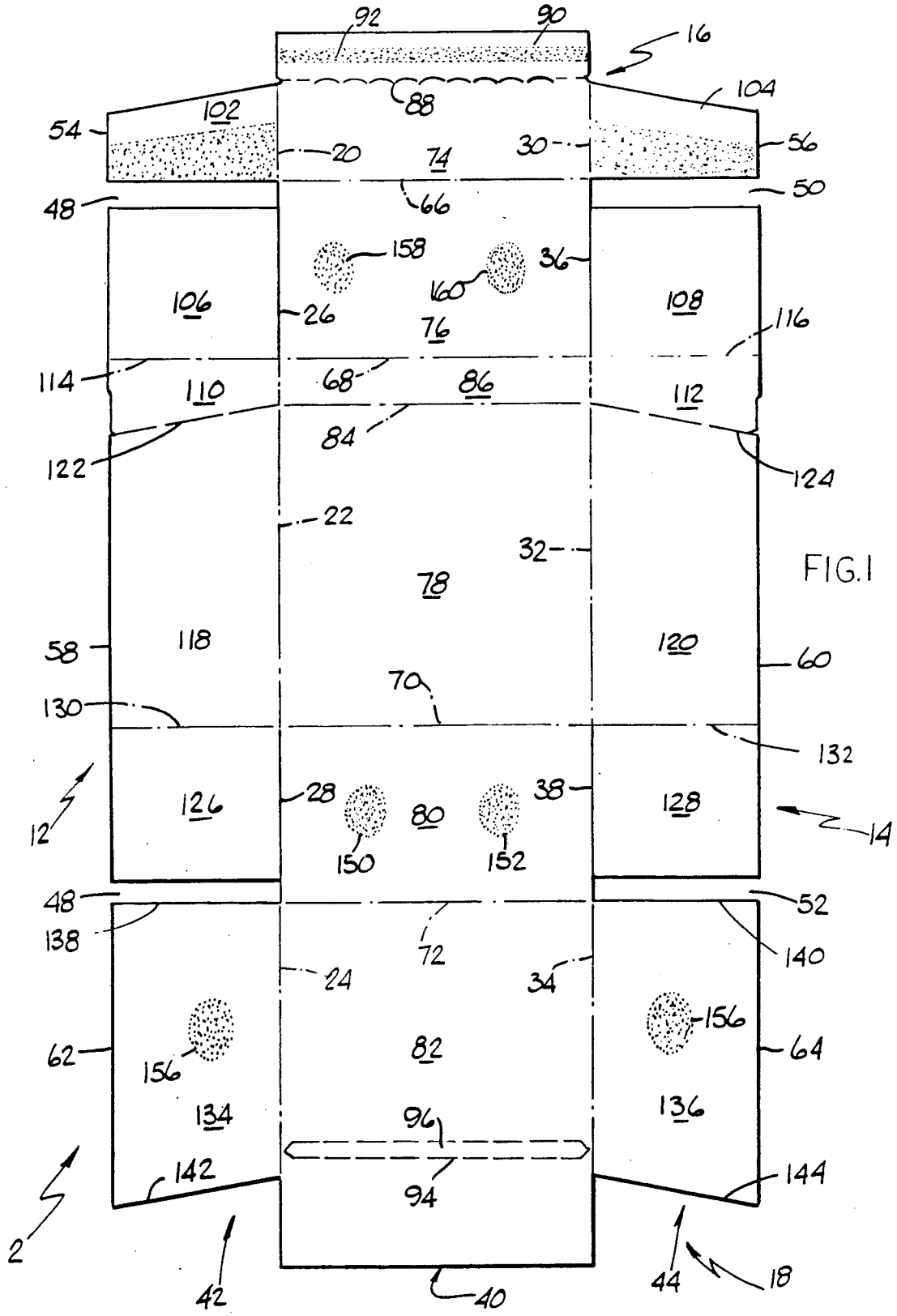
FIG. 1 is a top plan view of the inside portion of a carton blank of this invention.
FIG. 2 is an end elevational view of FIG. 1.
Figure 4:
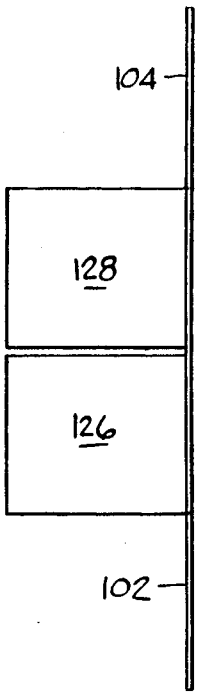
FIG. 4 is an end elevational view from the right side of FIG. 3.
Figure 3:
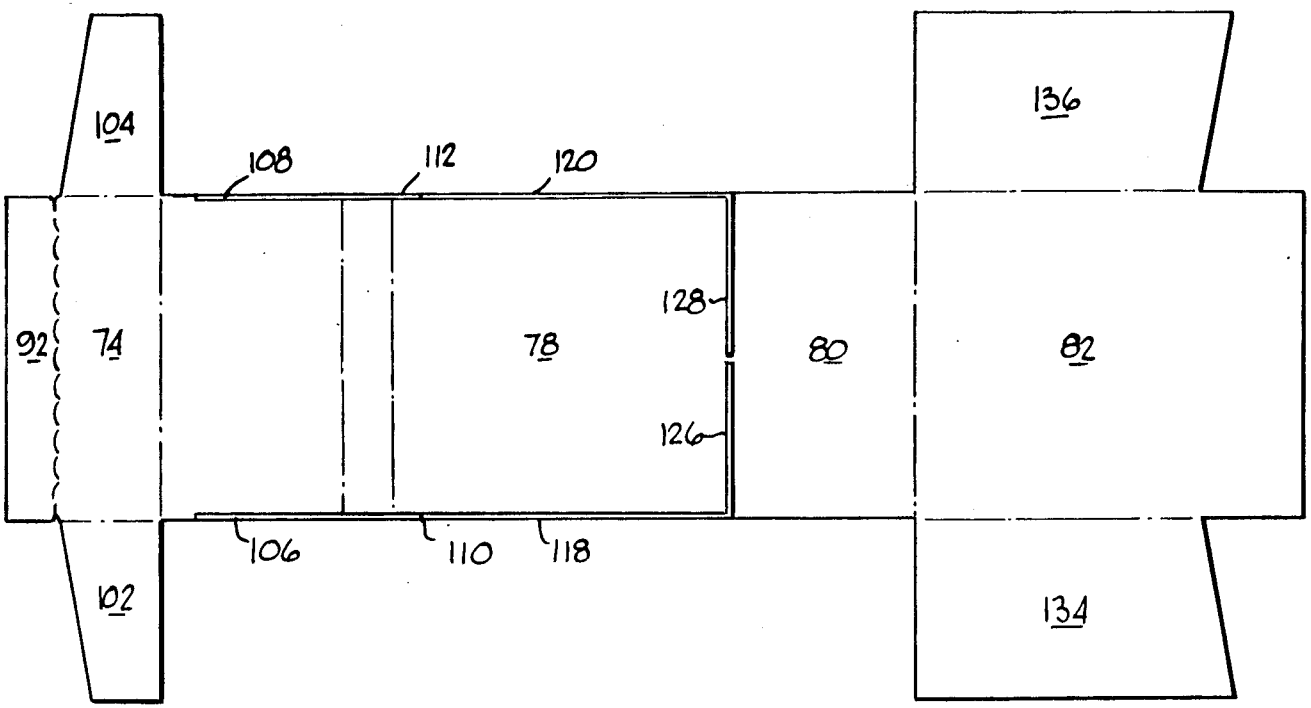
FIG. 3 is a top plan view of the carton blank after a first plurality of folding steps.
Figure 5:
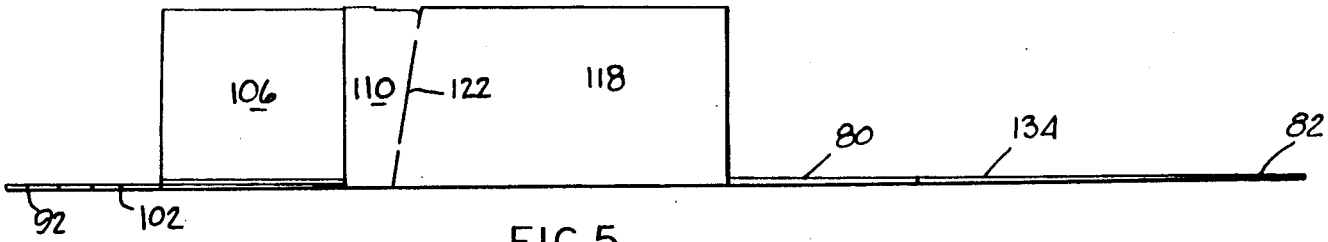
FIG. 5 is a side elevational view of FIG. 3.

FIG. 1 is a top plan view of the inside portion of the carton 4. The carton blank 2 is a unitary sheet of a composite laminate of layers of materials. As illustrated in FIG. 2, the inside layer 9 preferably comprises a paperboard material such as 0.021 inch DKL (recycled) or other similar materials such as natural Kraft board. The outside layer 10 comprises 0.75 mil polypropylene or other similar materials such as low density polyethylene which may be back printed to provide a desired appearance. Other thicknesses of the paperboard and plastic materials may be used. The method of forming the unitary sheet for forming the carton blank 2 is described in U.S. Pat. No. 4,254,173 to Peer, Jr., which is hereby incorporated herein by reference thereto.

The carton blank 2 has a left side edge 12, a right side edge 14, a top side edge 16 and a bottom edge 18 with the left and right side edges 12 and 14 being perpendicular to the top and bottom side edges 16 and 18. A first plurality of longitudinally extending fold lines 20, 22 and 24 and cut lines 26 and 28 cooperate with a second plurality of longitudinally extending fold lines 30, 32 and 34 and cut lines 36 and 38 to divide the carton blank 2 into a center section 40, a left side section 42 and a right side section 44. The left side section 42 has cut out portions 46 and 48 and the right side section 44 has cut out portions 50 and 52 to divide the left and right side sections 42 and 44 into first left and right side sub-sections 54 and 56, second left and right side sub-sections 58 and 60 and third left and right side sub-sections 62 and 64. The center section 40 has a plurality of transversely extending fold lines 66, 68, 70 and 72 to divide the center section into a lid front panel portion 74, a lid top panel portion 76, a back panel portion 78, a bottom panel portion 80 and a front panel portion 82. A hinge fold line 84 forms a lid back panel portion 86. A perforated line 88 forms a removable tab portion 90 having an adhesive strip 92 thereon. A continuous cut line 94 in the front panel portion 82, extending through the outside layer 10 and partially into the inside layer 9 forms a tear out panel portion 96 as described below.

The first left and right side sub-sections 54 and 56 comprise left and right lid inside side panels 102 and 104 integral with the lid front panel portion 74 and joined by fold lines 20 and 30.

The second left and right side sub-sections 58 and 60 comprise left and right lid top panel portion reinforcing tabs 106 and 108, left and right lid inside side panel portions 110 and 112 integral with the left and right lid top panel portion reinforcing tabs 106 and 108 and joined by transversely extending fold lines 114 and 116 and integral with the back panel portion 78 and joined by a portion of fold lines 22 and 32. Left and right inside side panel portions 118 and 120 are joined to left and right lid inside side panel portions by perforated lines 122 and 124, which have an angular relationship with the left and right side edges 12 and 14 that is greater or less than ninety degrees and are integral with the back panel portion 78 and joined thereto by portions of fold lines 22 and 32. Left and right bottom panel portion reinforcing tabs 126 and 128 are integral with left and right inside side panel portions 118 and 120 and are joined thereto by fold lines 130 and 132, which are perpendicular to the left and right side edges 12 and 14.

The third left and right side sub-sections 62 an 64 comprise left and right outside side panel portions 134 and 136 integral with the front panel portion 82 and joined thereto by fold lines 24 and 34 and have bottom edge portions 138 and 140 which are perpendicular to the left and right side edges 12 and 14 and top edge portions 142 and 144 which have an angular relationship with the left and right side edges 12 and 14 that is greater or less than 90 degrees.

The carton blank after the first sequence of folding steps to form the carton 4 is illustrated in FIGS. 3-8. In the first folding operations, illustrated in FIGS. 3-5, the second left and right sub-sections 58 and 60 have been folded 90 degrees around the fold lines 22 and 32. In view of the perforated lines 122 and 124, the cut lines 26, 36, 28 and 38 and the fold lines 114, 116, 130 and 132, the left and right lid top panel portion reinforcing tabs 106 and 108, the left and right lid inside side panel portions 110 and 112 and the left and right bottom panel portion reinforcing tabs 126 and 128 have moved through 90 degrees with the left and right inside side panel portions 118 and 120. The left and right bottom panel portion reinforcing tabs 126 and 128 have been folded 90 degrees around the fold lines 130 and 132.

Figure 6:
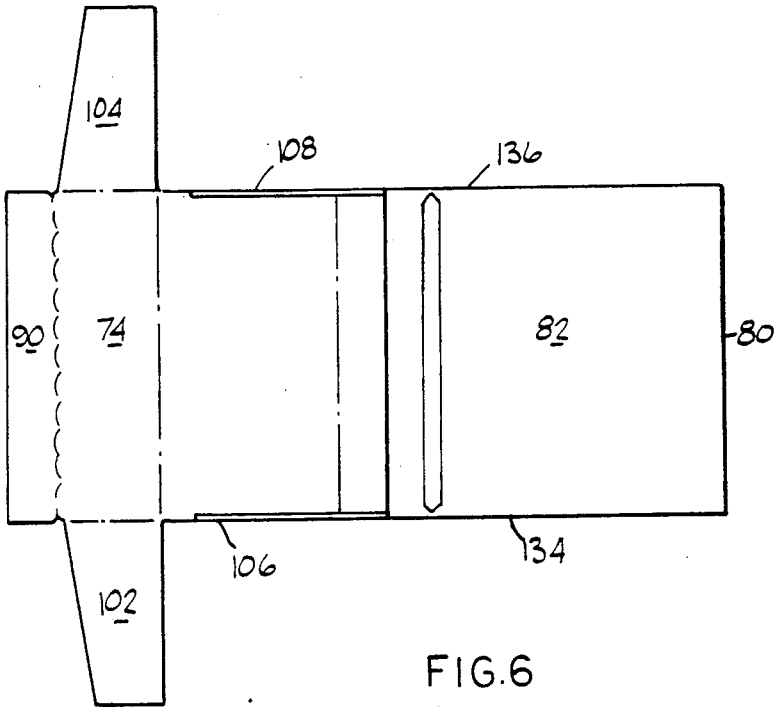
FIG. 6 is a top plan view of the carton blank after a second plurality of folding steps.
Figure 7:
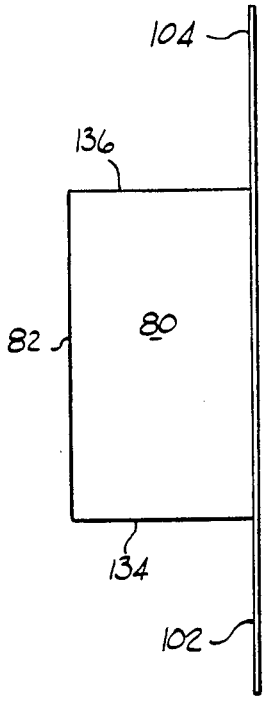
FIG. 7 is an end elevational view taken from the right side of FIG. 6.
Figure 8:
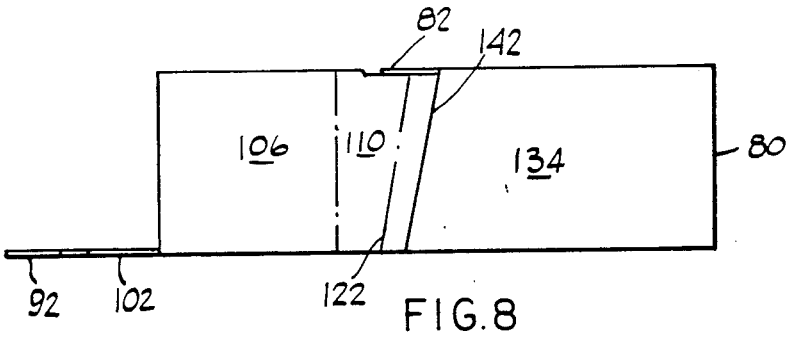
FIG. 8 is a side elevational view of FIG. 6.

The carton blank after the second sequence of folding steps is illustrated in FIGS. 6-8. The bottom panel portion 80 has been folded 90 degrees around the fold line 70 and secured to the left and right bottom panel reinforcing tabs 126 and 128 by adhesive 150 and 152. The front panel portion 82 has been folded 90 degrees around the fold line 72 with the left and right outside side panel portions 134 and 136 moving therewith for 90 degrees. The left and right outside side panel portions 134 and 136 have been folded 90 degrees around fold lines 24 and 34 secured to the left and right inside side panel portions 118 and 120 by adhesive 154 and 156. After the second sequence of folding steps, the partially formed carton 4 is ready to have the desired materials inserted therein.

Figure 9:
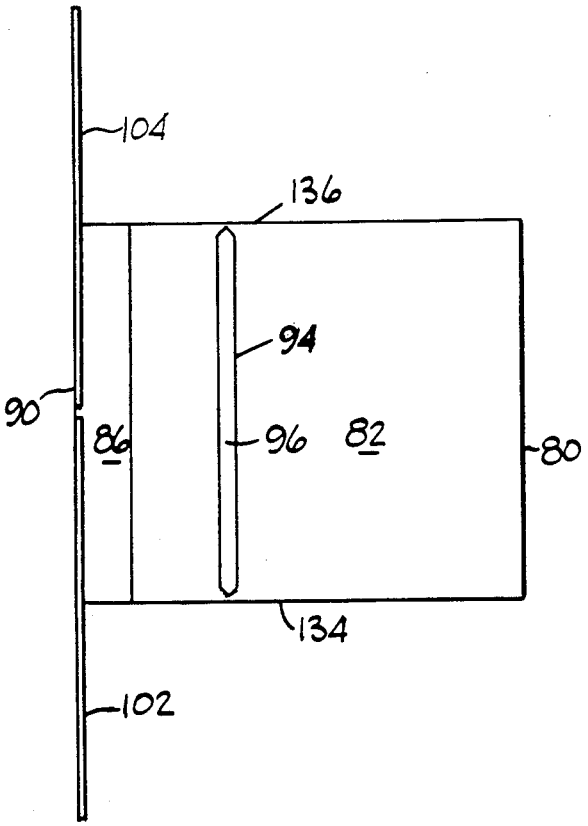
FIG. 9 is a top plan view of the carton blank after a third plurality of folding steps.
Figure 10:
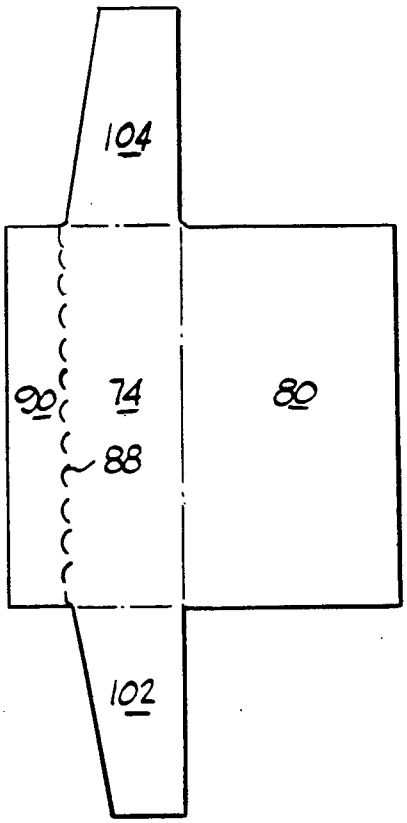
FIG. 10 is an end elevational view taken from the right side of FIG. 9.
Figure 11:
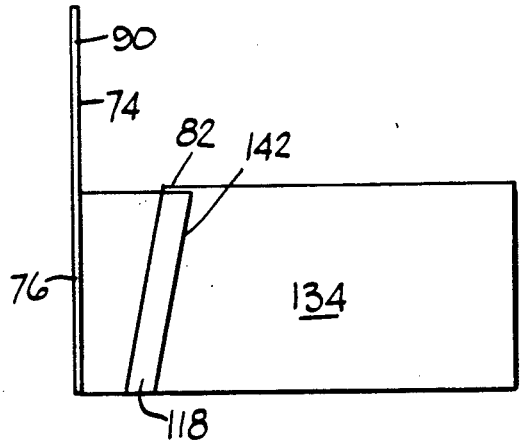
FIG. 11 is a side elevational view of FIG. 9.

The carton blank after the third sequence of folding steps is illustrated in FIGS. 9-11. The left and right lid top reinforcing panels 106 and 108 have been folded 90 degrees around fold lines 114 and 116. The lid top panel portion 76 has been folded 90 degrees around fold line 68 and secured to the left and right lid top reinforcing tabs 106 and 108 by adhesive 158 and 160.

Figure 12:
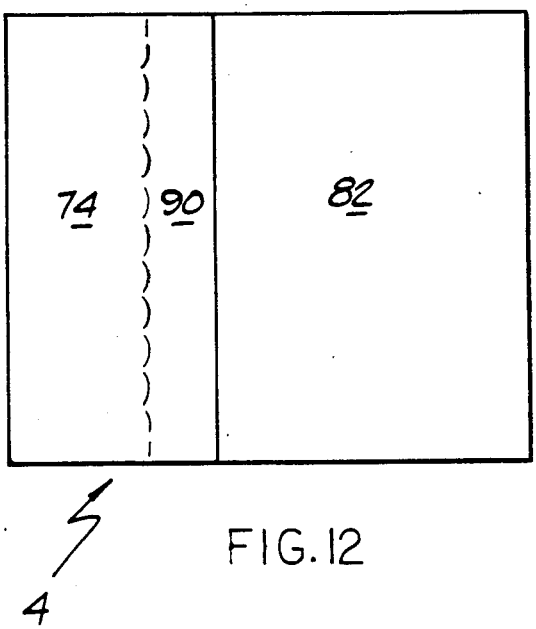
FIG. 12 is a top plan view of the carton blank after a fourth plurality of folding steps.
Figure 13:
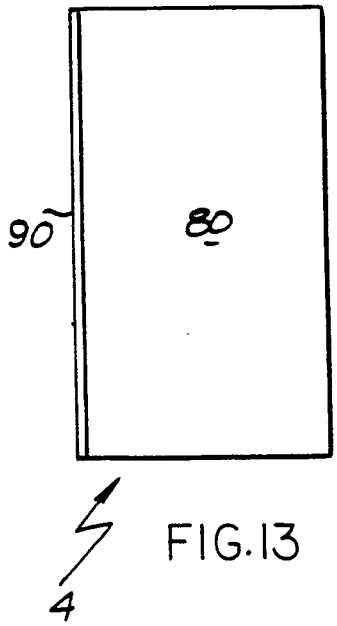
FIG. 13 is an end elevational view taken from the right side of FIG. 12.

The carton blank after the fourth sequence of folding steps is illustrated in FIGS. 12-14. The lid front panel portion 74 and the removable tab 90 have been folded 90 degrees around the fold line 66 and the removable tab 90 is secured to the tear away panel 96 by the adhesive strip 92. The left and right lid outside side panel portions 102 and 104 have been folded 90 degrees around fold lines 20 and 30 and portions thereof have been secured to the left and right lid inside side panel portions 110 and 112 by adhesive 162 and 164. The carton 4 is now ready for shipment, storage and sale.

When the user is ready to open the carton 4, the edge of the removable tab 90 is grasped and a force is applied thereto to tear the removable tab 90 along the perforated line 88. The tear away panel portion 96 is removed at the same time. An upward force is then applied to the lid front panel portion 74 to separate the left and right lid inside side panel portions 110 and 112 along the perforated lines 122 and 124. This functions to form left and right side lid abutment edges 166 and 168, FIG. 16, since, as illustrated in FIG. 1, the left and right lid inside side panel portions 110 and 112 are dimensionally smaller than the left and right lid outside side panel portions 102 and 104. Also, abutment edges are formed by the top edge portions 142 and 144 of the left and right outside side panel portions 134 and 136 since they are dimensionally smaller than the left and right inside side panel portions 118 and 120.

When the lid is in the fully closed position, the abutment edges 166 and 168 are in contact with the abutment edges 142 and 144 so that portions of the left and right lid outside side panel portions 102 and 104 are in superposed relationship with portions of the left and right inside side panel portions 118 and 120 and portions of the lid front panel portion 74 are in superposed relationship with portions of the front panel portion 82. Also, the top edge 170 of the front panel portion is located a distance above the top edges 172 and 174 of the left and right inside side panel portions 118 and 120 and is in frictional engagement with portions of the lid front panel portion 76 to hold the lid in the closed position. There also may be some frictional engagements with the top side edges 176 and 178 with portions of the left and right lid inside side panel portion 110 and 112.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A carton blank comprising:

a unitary sheet of material;

said unitary sheet of material having a left side edge, a right side edge, a top edge and a bottom edge, said left and right side edges being perpendicular to said top and bottom edges;

a first plurality of spaced apart cut and fold lines extending from said top edge to said bottom edge;

a second plurality of spaced apart cut and fold lines extending from said top edge to said bottom edge;

said first and second plurality of cut and fold lines dividing said unitary sheet of material into a center section, a left side section and a right side section;

said center section having a plurality of transversely extending fold lines for dividing said center section from said top edge to said bottom edge into a lid front panel portion, a lid top panel portion, a lid back panel portion, a back panel portion, a bottom panel portion and a front panel portion;

each of said left and right side sections having cut out portions to divide each of said left and right side sections into first left and right side sub-sections, second left and right side sub-sections and third left and right side sub-sections;

said first left and right side sub-sections comprising left and right lid outside side panel portions integral with said lid front panel portion;

said second left and right side sub-sections comprising left and right lid top panel portion reinforcing tabs, left and right lid inside side panel portions, left and right inside side panel portions and left and right bottom panel portion reinforcing tabs; and said third left and right sub-sections comprising left and right outside side panel portions.

2. The invention as in claim 1 wherein:

said left and right lid top panel portion reinforcing tabs being separated from said center section by cut lines; and said left and right bottom panel portion reinforcing tabs being separated from said center section by cut lines.

3. The invention as in claim 2 wherein:

said left and right side lid top panel portion reinforcing tabs being integral with said left and right lid inside side panel portions and having a fold line formed therebetween;

said left and right lid inside side panel portions connected to said left and right inside side panel portions by a severable perforated line; and said left and right side bottom panel portion reinforcing tabs being integral with said left and right inside side panels and having a fold line formed therebetween.

4. The invention as in claim 3 wherein:

said left and right lid inside side panel portions being integral with said lid front panel portion and having fold lines therebetween;

said left and right inside side panel portions being integral with said back panel portion and having fold lines therebetween; and said left and right outside side panel portions being integral with said front panel and having fold lines therebetween.

5. The invention as in claim 4 wherein:

said lid top panel portion having a length in the longitudinal direction which is greater than the length of said bottom panel portion in the longitudinal direction.

6. The invention as in claim 5 and further comprising:

a closed continuous cut line forming a tear away portion on said front panel portion;

said closed continuous cut line extending only partially into said front panel portion; and said tear away portion being located so that a portion of said removable tab is superposed over and adhesively secured to said tear away portion so that, when said removable tab is removed, said tear away portion will be removed therewith.

7. A method for forming a carton so that it can be filled with material using a carton blank which comprises a unitary sheet of material; said unitary sheet of material having a left side edge, a right side edge, a top edge and a bottom edge, said left and right side edges being perpendicular to said top and bottom edges; a first plurality of spaced apart cut and fold lines extending from said top edge to said bottom edge; a second plurality of spaced apart cut and fold lines extending from said top edge to said bottom edge; said first and second plurality of cut and fold lines dividing said unitary sheet of material into a center section, a left side section and a right side sections; said center section having a plurality of transversely extending fold lines for dividing said center section from said top edge to said bottom edge into a lid front panel portion, a lid top panel portion, a lid back panel portion, a back panel portion, a bottom panel portion and a front panel portion; each of said left and right side sections having cut out portions to divide each of said left and right side sections into first left and right side sub-sections, second left and right side sub-sections and third left and right side sub-sections; said first left and right side sub-sections comprising left and right lid outside side panel portions integral with said lid front panel portion; said second left and right side sub-sections comprising left and right lid top panel portions reinforcing tabs, left and right lid inside side panel portions, left and right inside side panel portions and left and right bottom panel portion reinforcing tabs; said third left and right sub-sections comprising left and right outside side panel portions; said left and right lid top panel portion reinforcing tabs being separated from said center section by cut lines; said left and right bottom panel portion reinforcing tabs being separated from said center section by cut lines; said left and right side lid top panel portion reinforcing tabs being integral with said left and right lid inside side panel portions and having a fold line formed therebetween; said left and right lid inside side panel portions connected to said left and right inside side panel portions by a severable perforated line; said left and right side bottom panel portion reinforcing tabs being integral with said left and right inside side panels and having a fold line formed therebetween; said left and right lid inside side panel portions being integral with said lid front panel portion and having fold lines therebetween; said left and right inside side panel portions being integral with said back panel portion and having fold lines therebetween; and said left and right outside side panel portions being integral with said front panel and having fold lines therebetween comprising the steps of:

folding said left and right inside side panels and said left and right lid side reinforcing tabs around said fold lines between them and said back panel portion through 90 degrees with said left and right side lid top panel portion reinforcing tabs and said left and right side bottom panel reinforcing tabs moving therewith;

folding said left and right bottom panel portion reinforcing tabs through 90 degrees;

securing said left and right bottom panel reinforcing tabs to said bottom panel portion together;

folding said front panel portion through 90 degrees so that said left and right outside side panel portions move therewith;

folding said left and right outside side panel portions through 90 degrees so that they are in superposed relationship with said left and right inside side panel portions; and securing said left and right inside and outside side panel portions together.

8. The invention as in claim 7 and further comprising, after desired materials have been placed into said carton, the steps of:

folding said left and right lid top panel portion reinforcing tabs through 90 degrees;

folding said lid top panel portion through 90 degree so that said lid top panel portion and said left and right lid top panel portion reinforcing tabs and said lid top panel portion are in superposed relationship;

securing said left and right lid top panel portion reinforcing tabs and said lid top panel portion together;

folding said lid front panel portion through 90 degrees so that said left and right lid outside side panel portions move therewith and portions of said lid front panel portion overlap portions of said front panel portion;

folding said left and right lid outside side panel portions through 90 degrees so that they are in superposed relationship with said left and right lid inside side panel portions;

securing at least portions of said left and right lid outside side panel portions and said left and right lid inside side panel portions together; and securing said removable tab to at least a portion of said front panel portion.

9. A carton for holding material comprising:

front and back panel portions having the same height and width;

opposite outside side panel portions having a height and width, each of which being less than said height and width of said front and back panel portion;

said opposite outside side panel portions being integral with and joined to opposite sides of said front panel portion by folds;

opposite inside side panel portions having a height greater than said height of said opposite outside side panel portions and a width substantially the same as said width of said opposite outside side panel portions;

said opposite inside side panel portions being integral with and joined to opposite sides of said back panel portion by folds;

a bottom panel portion having first width equal to said width of said front and back panel portions and a second width equal to said width of said opposite side panel portions;

said front and back panel portions, said opposite outside and inside side panel portions and said bottom panel portion connected together to form a carton having an open top portion;

each of said opposite inside side panel portions having a height at said folds between said back panel portion and said opposite inside side panel portions that is greater than the height of said opposite outside side panel portions at said folds between said front panel portion and said opposite outside side panel portions;

a lid portion hingedly secured to said back panel portion for permitting movement of said lid portion between closed and opened positions;

securing means for securing together said outside side panel portions and said inside side panel portions to form laminates thereof; and said opposite outside side panel portions being dimensionally smaller than said opposite inside side panel portions to form generally transversely extending abutment edges on said opposite outside side panel portions.

10. The invention as in claim 9 wherein said lid portion comprise:

a lid back panel portion hingedly secured to said back panel portion and having a height and a width;

a lid front panel portion having a height greater than said height of said lid back panel portion and a width lid equal to said width of said lid back panel portion;

opposite lid side panel portions each having the same height and width;

a lid top panel portion having a first width equal to said width of said lid front and back panel portions and a second width equal to said width of said opposite lid side panel portions; and each of said opposite lid side panel portions having a height at the juncture of said lid back panel portion and said opposite lid side panel portions that is less than the height of said opposite lid side panel portions at the juncture of said lid front panel portion and said opposite lid side panel portions.

11. The invention as in claim 10 wherein each of said opposite lid side panel portions comprise:

a laminate comprising an integral extension of said lid front panel portion and an integral extension of said lid rear panel portion.

12. The invention as in claim 11 wherein:

said integral extensions of said lid inside side panel portions being dimensionally smaller than said integral extensions of said lid outside side panel portions to form generally transversely extending abutment edges on said integral extensions of said lid inside side panel portions.

13. The invention as in claim 12 wherein:

said abutment edge on said extensions of said lid back panel portion being in contact with said abutment edges on said extensions of said front panel portion when said lid portion is in said closed position.

14. The invention as in claim 9 and further comprising:

movement restraining means for restraining movement of said lid portion between said closed and opened positions and for holding said lid portion in said closed position.

15. The invention as in claim 14 wherein said lid portion comprises:

a lid back panel portion hingedly secured to said back panel portion and having a height and width;

a lid front panel portion having a height greater than said height of said lid back panel portion and a width equal to said width of said lid back panel portion;

opposite lid side panel portions;

each of said opposite lid side panel portions comprising lid outside side panel portions integral with and joined to said lid front panel portion by folds and lid inside side panel portions integral with and joined to said lid back panel portion by folds;

a lid top panel portion having a first width equal to said width of said lid front and back panel portions and a second width equal to said width of said opposite lid side panel portions;

each of said opposite lid inside side panel portions having a height at said folds between said lid back panel portion and said opposite lid inside side panel portions that is less than the height of said opposite lid outside side panel portions at said folds between said lid front panel portion and said opposite lid outside side panel portions;

said left and right lid top panel portion reinforcing tabs being separated from said center section by cut lines; and said left and right bottom panel portion reinforcing tabs being separated from said center section by cut lines.

16. The invention as in claim 15 wherein said movement restraining means comprises:

said lid front panel portion having a terminal edge portion;

a projecting member secured to said terminal edge portion by a perforated score line; and securing means for securing said projecting member to a portion of said front panel portion.

17. The invention as in claim 16 and further comprising:

a continuous cut having spaced apart widthwise extending portions and spaced apart heightwise extending portions formed in said front panel portion;

said continuous cut extending only partially through said front panel portion to form a severable portion;

said severable portion being in a superposed relationship with a portion of said projecting member; and adhesive means for joining said severable portion to said superposed portion of said projecting member so that, when a force is applied to said projecting member to sever it along said perforated score line, said severable portion will move with said projecting member.

18. The invention as in claim 17 wherein:

said carton is formed from one carton blank.

* * * * *